US009978231B2

(12) United States Patent
Isaacs

(10) Patent No.: US 9,978,231 B2
(45) Date of Patent: May 22, 2018

(54) TAMPER-RESPONDENT ASSEMBLY WITH PROTECTIVE WRAP(S) OVER TAMPER-RESPONDENT SENSOR(S)

(71) Applicant: INTERNATIONAL BUSINESS MACHINES CORPORATION, Armonk, NY (US)

(72) Inventor: Phillip Duane Isaacs, Rochester, MN (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 188 days.

(21) Appl. No.: 14/918,691

(22) Filed: Oct. 21, 2015

(65) Prior Publication Data

US 2017/0116830 A1 Apr. 27, 2017

(51) Int. Cl.
*G08B 13/12* (2006.01)

(52) U.S. Cl.
CPC ..... *G08B 13/128* (2013.01)

(58) Field of Classification Search
None
See application file for complete search history.

(56) References Cited

U.S. PATENT DOCUMENTS 3,165,569 A 1/1965 Bright et al.
4,160,503 A 7/1979 Ohlbach
(Continued)

FOREIGN PATENT DOCUMENTS

CN 201430639 Y 3/2010
CN 104346587 A 2/2015
(Continued)

OTHER PUBLICATIONS

Yee, Bennet, "Using Secure Coprocessors", May 1994, School of Computer Science, Carnegie Mellon University.*
(Continued)

*Primary Examiner* — Firmin Backer
*Assistant Examiner* — Shawna M Kingston
(74) *Attorney, Agent, or Firm* — Margaret A. McNamara, Esq.; Kevin P. Radigan, Esq.; Heslin, Rothenberg, Farley & Mesiti, P.C.

(57) ABSTRACT

Tamper-respondent assemblies and methods of fabrication are provided which include an inner enclosure, a tamper-respondent sensor(s), a protective wrap(s) and an outer enclosure. The inner enclosure is sized to receive one or more electronic components to be protected, and the tamper-respondent sensor(s) wraps around the inner enclosure. The protective wrap(s) overlies and wraps around the tamper-respondent sensor(s) and inner enclosure, and together the inner enclosure, tamper-respondent sensor(s), and protective wrap(s) form a tamper-respondent subassembly. The outer enclosure receives and surrounds, at least in part, the tamper-respondent subassembly, with the tamper-respondent sensor(s) and protective wrap(s) disposed between the inner enclosure and the outer enclosure. When operative, the inner enclosure, tamper-respondent sensor(s), protective wrap(s) and outer enclosure are coupled together and facilitate conduction of heat from the electronic component(s) out to the outer enclosure.

20 Claims, 9 Drawing Sheets

(56) References Cited

U.S. PATENT DOCUMENTS 4,211,324 A 7/1980 Ohlbach
4,324,823 A 4/1982 Ray, III
4,516,679 A 5/1985 Simpson et al.
4,496,900 A 6/1985 Di Stefano et al.
4,593,384 A 6/1986 Kleijne
4,609,104 A 9/1986 Kasper et al.
4,653,252 A 3/1987 van de Haar et al.
4,677,809 A 7/1987 Long et al.
4,691,350 A 9/1987 Kleijne et al.
4,807,284 A 2/1989 Kleijne
4,811,288 A 3/1989 Kleijne et al.
4,860,351 A 8/1989 Weingart
4,865,197 A 9/1989 Craig
5,009,311 A 4/1991 Schenk
5,027,397 A 6/1991 Double et al.
5,060,114 A 10/1991 Feinberg et al.
5,075,822 A 12/1991 Baumler et al.
5,117,457 A 5/1992 Comerford et al.
5,159,629 A 10/1992 Double et al.
5,185,717 A 2/1993 Mori
5,201,868 A 4/1993 Johnson
5,201,879 A 4/1993 Steele
5,211,618 A 5/1993 Stoltz
5,239,664 A 8/1993 Verrier et al.
5,389,738 A 2/1995 Piosenka et al.
5,406,630 A 4/1995 Piosenka et al.
5,506,566 A 4/1996 Oldfield et al.
5,568,124 A 10/1996 Joyce et al.
5,594,439 A 1/1997 Swanson
5,675,319 A 10/1997 Rivenberg et al.
5,715,652 A 2/1998 Stahlecker
5,761,054 A 6/1998 Kuhn
5,813,113 A 9/1998 Stewart et al.
5,858,500 A 1/1999 MacPherson
5,880,523 A 3/1999 Candelore
5,988,510 A 11/1999 Tuttle et al.
6,121,544 A 9/2000 Petsinger
6,195,267 B1 2/2001 MacDonald, Jr. et al.
6,201,296 B1 3/2001 Fries et al.
6,261,215 B1 7/2001 Imer
6,301,096 B1 10/2001 Wozniczka
6,384,397 B1 5/2002 Takiar et al.
6,424,954 B1 7/2002 Leon
6,438,825 B1 8/2002 Kuhn
6,469,625 B1 10/2002 Tomooka
6,473,304 B1 10/2002 Stevens
6,512,454 B2 1/2003 Miglioli et al.
6,643,995 B1 11/2003 Kayama et al.
6,686,539 B2 2/2004 Farquhar et al.
6,746,960 B2 6/2004 Goodman
6,798,660 B2 9/2004 Moss et al.
6,853,093 B2 2/2005 Cohen et al.
6,879,032 B2 4/2005 Rosenau et al.
6,929,900 B2 8/2005 Farquhar et al.
6,946,960 B2 9/2005 Sisson et al.
6,957,345 B2 10/2005 Cesana et al.
6,970,360 B2 11/2005 Sinha
6,985,362 B2 1/2006 Mori et al.
6,991,961 B2 1/2006 Hubbard et al.
6,996,953 B2 2/2006 Perreault et al.
7,005,733 B2 2/2006 Kommerling et al.
7,015,823 B1 3/2006 Gillen et al.
7,054,162 B2 5/2006 Benson et al.
7,057,896 B2 6/2006 Matsuo et al.
7,094,143 B2 8/2006 Wolm et al.
7,094,459 B2 8/2006 Takahashi
7,095,615 B2 8/2006 Nichols
7,156,233 B2 1/2007 Clark et al.
7,180,008 B2 2/2007 Heitmann et al.
7,189,360 B1 3/2007 Ho
7,214,874 B2 5/2007 Dangler et al.
7,247,791 B2 7/2007 Kulpa
7,304,373 B2 12/2007 Taggart et al.
7,310,737 B2 12/2007 Patel et al.
7,465,887 B2 12/2008 Suzuki et al.
7,475,474 B2 1/2009 Heitmann et al.
7,515,418 B2 4/2009 Straznicky et al.
7,549,064 B2 6/2009 Elbert et al.
7,640,658 B1 1/2010 Pham et al.
7,643,290 B1 1/2010 Narasimhan et al.
7,663,883 B2 2/2010 Shirakami et al.
7,672,129 B1 3/2010 Ouyang et al.
7,731,517 B2 6/2010 Lee et al.
7,746,657 B2 6/2010 Oprea et al.
7,760,086 B2 7/2010 Hunter et al.
7,768,005 B2 8/2010 Condorelli et al.
7,783,994 B2 8/2010 Ball et al.
7,787,256 B2 8/2010 Chan et al.
7,868,441 B2 1/2011 Eaton et al.
7,898,413 B2 3/2011 Hsu et al.
7,901,977 B1 3/2011 Angelopoulos et al.
7,947,911 B1 5/2011 Pham et al.
7,978,070 B2 7/2011 Hunter
8,084,855 B2 12/2011 Lower et al.
8,094,450 B2 1/2012 Cole
8,101,267 B2 1/2012 Samuels et al.
8,133,621 B2 3/2012 Wormald et al.
8,199,506 B2 6/2012 Janik et al.
8,287,336 B2 10/2012 Dangler et al.
8,325,486 B2 12/2012 Arshad et al.
8,516,269 B1 8/2013 Hamlet et al.
8,589,703 B2 11/2013 Lee
8,646,108 B2 2/2014 Shiakallis et al.
8,659,506 B2 2/2014 Nomizo
8,659,908 B2 2/2014 Adams et al.
8,664,047 B2 3/2014 Lower et al.
8,716,606 B2 5/2014 Kelley et al.
8,797,059 B2 8/2014 Boday et al.
8,836,509 B2 9/2014 Lowy
8,853,839 B2 10/2014 Gao et al.
8,879,266 B2 11/2014 Jarvis et al.
8,890,298 B2 11/2014 Buer et al.
8,947,889 B2 2/2015 Kelley et al.
8,961,280 B2 2/2015 Dangler et al.
9,003,199 B2 4/2015 Dellmo et al.
9,011,762 B2 4/2015 Seppa et al.
9,052,070 B2 6/2015 Davis et al.
9,166,586 B2 10/2015 Carapelli et al.
9,298,956 B2 3/2016 Wade et al.
9,578,764 B1 * 2/2017 Fisher ..... H05K 5/0208
9,591,776 B1 * 3/2017 Brodsky ..... H05K 5/0208
2001/0050425 A1 12/2001 Beroz et al.
2001/0056542 A1 12/2001 Cesana et al.
2002/0002683 A1 1/2002 Benson
2002/0068384 A1 6/2002 Beroz et al.
2002/0084090 A1 7/2002 Farquhar
2003/0009684 A1 1/2003 Schwenck et al.
2005/0068735 A1 3/2005 Fissore et al.
2005/0111194 A1 5/2005 Sohn et al.
2005/0180104 A1 8/2005 Olesen et al.
2006/0034731 A1 2/2006 Lewis et al.
2006/0072288 A1 4/2006 Stewart et al.
2006/0196945 A1 9/2006 Mendels
2006/0218779 A1 10/2006 Ooba et al.
2007/0064396 A1 3/2007 Oman et al.
2007/0064399 A1 3/2007 Mandel et al.
2007/0108619 A1 5/2007 Hsu
2007/0211436 A1 9/2007 Robinson et al.
2007/0230127 A1 10/2007 Peugh et al.
2007/0268671 A1 11/2007 Brandenburg et al.
2008/0050512 A1 2/2008 Lower et al.
2008/0144290 A1 6/2008 Brandt et al.
2008/0159539 A1 7/2008 Huang et al.
2008/0160274 A1 7/2008 Dang et al.
2008/0191174 A1 8/2008 Ehrensvard et al.
2008/0251906 A1 10/2008 Eaton et al.
2009/0073659 A1 3/2009 Peng et al.
2009/0166065 A1 7/2009 Clayton et al.
2010/0088528 A1 4/2010 Sion
2010/0110647 A1 5/2010 Hiew et al.
2010/0177487 A1 7/2010 Arshad et al.
2010/0319986 A1 12/2010 Bleau et al.
2011/0001237 A1 1/2011 Brun et al.
2011/0038123 A1 2/2011 Janik et al.

(56) References Cited

U.S. PATENT DOCUMENTS

| | | | |
|---|---|---|---|
| 2011/0103027 | A1 | 5/2011 | Aoki et al. |
| 2011/0241446 | A1 | 10/2011 | Tucholski |
| 2011/0299244 | A1 | 12/2011 | Dede et al. |
| 2012/0050998 | A1 | 3/2012 | Klum et al. |
| 2012/0117666 | A1 | 5/2012 | Oggioni et al. |
| 2012/0140421 | A1 | 6/2012 | Kirstine et al. |
| 2012/0149150 | A1 | 6/2012 | Toh et al. |
| 2012/0170217 | A1 | 7/2012 | Nishikimi et al. |
| 2012/0185636 | A1 | 7/2012 | Leon et al. |
| 2012/0244742 | A1 | 9/2012 | Wertz et al. |
| 2012/0256305 | A1 | 10/2012 | Kaufmann et al. |
| 2012/0320529 | A1 | 12/2012 | Loong et al. |
| 2013/0033818 | A1 | 2/2013 | Hosoda et al. |
| 2013/0104252 | A1 | 4/2013 | Yanamadala et al. |
| 2013/0141137 | A1 | 6/2013 | Krutzik et al. |
| 2013/0158936 | A1 | 6/2013 | Rich et al. |
| 2013/0208422 | A1 | 8/2013 | Hughes et al. |
| 2013/0235527 | A1 | 9/2013 | Wagner et al. |
| 2013/0283386 | A1 | 10/2013 | Lee |
| 2014/0022733 | A1 | 1/2014 | Lim et al. |
| 2014/0160679 | A1 | 6/2014 | Kelty et al. |
| 2014/0184263 | A1 | 7/2014 | Ehrenpfordt et al. |
| 2014/0204533 | A1 | 7/2014 | Abeyasekera et al. |
| 2014/0321064 | A1 | 10/2014 | Bose et al. |
| 2014/0325688 | A1 | 10/2014 | Cashin et al. |
| 2015/0007427 | A1 | 1/2015 | Dangler et al. |
| 2015/0235053 | A1 | 8/2015 | Lee et al. |
| 2016/0005262 | A1 | 1/2016 | Hirato et al. |

FOREIGN PATENT DOCUMENTS

| | | | |
|---|---|---|---|
| DE | 19816571 | A1 | 10/1999 |
| DE | 102012203955 | A1 | 9/2013 |
| EP | 000566360 | A1 | 10/1993 |
| EP | 0629497 | A2 | 12/1994 |
| EP | 1184773 | A1 | 3/2002 |
| EP | 1207444 | A2 | 5/2002 |
| EP | 1 734 578 | A1 | 12/2006 |
| EP | 1968362 | A2 | 9/2008 |
| EP | 2104407 | A1 | 9/2009 |
| EP | 1 672 464 | B1 | 4/2012 |
| EP | 2560467 | A1 | 2/2013 |
| JP | 61-297035 | A | 12/1986 |
| JP | 2000-238141 | A | 9/2000 |
| JP | 2013125807 | A | 6/2013 |
| JP | 2013-140112 | A | 7/2013 |
| WO | WO9903675 | A1 | 1/1999 |
| WO | WO1999/021142 | A1 | 4/1999 |
| WO | WO2001/063994 | A2 | 8/2001 |
| WO | WO 2003/012606 | A2 | 2/2003 |
| WO | WO03025080 | A1 | 3/2003 |
| WO | WO2004040505 | A1 | 5/2004 |
| WO | WO 2009/042335 | A1 | 4/2009 |
| WO | WO2009/092472 | A1 | 7/2009 |
| WO | WO2010/128939 | A1 | 11/2010 |
| WO | WO2013/004292 | A1 | 1/2013 |
| WO | WO 2013/189483 | | 12/2013 |
| WO | WO2014/086987 | A2 | 6/2014 |
| WO | WO2014/158159 | A1 | 10/2014 |

OTHER PUBLICATIONS

Tygar, J.D., Yee, Bennet S., "Dyad: a System for Using Physically Secure Coprocessors", 1991, Carnegie Mellon University, Research Showcase @ CMU.*

Anonymous, "Consolidated Non-Volatile Memory in a Chip Stack", IBM Technical Disclosure: IP.com No. IPCOM000185250, Jul. 16, 2009 (6 pages).

Anonymous, "Selective Memory Encryption", IBM Technical Disclosure: IP.com No. IPCOM000244183, Nov. 20, 2015 (6 pages).

Busby et al., "Multi-Layer Stack with Embedded Tamper-Detect Protection", U.S. Appl. No. 15/053,336, filed Feb. 25, 2016 (68 pages).

Isaacs, Phillip Duane, "List of IBM Patents and/or Patent Applications Treated as Related", U.S. Appl. No. 14/918,691, filed Oct. 21, 2015, dated Mar. 7, 2016 (2 pages).

Simek, Bob, "Tamper Restrictive Thermal Ventilation System for Enclosures Requiring Ventilation and Physical Security", IBM Publication No. IPCOM000008607D, Mar. 1, 1998 (2 pages).

Saran et al., "Fabrication and Characterization of Thin Films of Single-Walled Carbon Nanotube Bundles on Flexible Plastic Substrates", Journal of the American Chemical Society, vol. 126, No. 14 (Mar. 23, 2004) (pp. 4462-4463).

Khanna P.K. et al., "Studies on Three-Dimensional Moulding, Bonding and Assembling of Low-Temperature-Cofired Ceramics MEMS and MST Applications." Materials Chemistry and Physics, vol. 89, No. 1 (2005) (pp. 72-79).

Loher et al., "Highly Integrated Flexible Electronic Circuits and Modules", 3rd International IEEE on Microsystems, Packaging, Assembly & Circuits Technology Conference (Oct. 22-24, 2008) (Abstract Only) (1 page).

Drimer et al., "Thinking Inside the Box: System-Level Failures of Tamper Proofing", 2008 IEEE Symposium on Security and Privacy, (Feb. 2008) (pp. 281-295).

Fisher et al., "Embedded Venting System", U.S. Appl. No. 14/797,232, filed Jul. 13, 2015 (35 pages).

Isaacs et al., "Electronic Package with Heat Transfer Element(s)", U.S. Appl. No. 14/637,501, filed Mar. 4, 2015 (30 pages).

Isaacs et al., "Electronic Package with Heat Transfer Element(s)", U.S. Appl. No. 14/846,897, filed Sep. 7, 2015 (27 pages).

Dangler et al., "Tamper-Respondent Sensors with Formed Flexible Layer(s)", U.S. Appl. No. 14/865,551, filed Sep. 25, 2015 (113 pages).

Brodsky et al., "Overlapping, Discrete Tamper-Respondent Sensors", U.S. Appl. No. 14/865,572, filed Sep. 25, 2015 (114 pages).

Danger et al., "Tamper-Respondent Assemblies with Region(s) of Increased Susceptibility to Damage", U.S. Appl. No. 14/865,591, filed Sep. 25, 2015 (114 pages).

Brodsky et al., "Circuit Boards and Electronic Packages with Embedded Tamper-Respondent Sensor", U.S. Appl. No. 14/865,610, filed Sep. 25, 2015 (43 pages).

Brodsky et al, "Tamper-Respondent Assemblies", U.S. Appl. No. 14/865,632, filed Sep. 25, 2015 (115 pages).

Brodksky et al., "Enclosure with Inner Tamper-Respondent Sensor(s)", U.S. Appl. No. 14/865,651, filed Sep. 25, 2015 (115 pages).

Fisher et al., "Enclosure with Inner Tamper-Respondent Sensor(s) and Physical Security Element(s)", U.S. Appl. No. 14/865,686, filed Sep. 25, 2015 (114 pages).

Brodsky et al., "Tamper-Respondent Assemblies with Bond Protection", U.S. Appl. No. 14/865,708, filed Sep. 25, 2015 (113 pages).

Brodsky et al., "Circuit Layouts of Tamper-Respondent Sensors", U.S. Appl. No. 14/886,179, filed Oct. 19, 2015 (113 pages).

Isaacs, Phillip Duane, "List of IBM Patents and Patent Applications Treated as Related", U.S. Appl. No. 14/918,691, filed Oct. 21, 2015, dated Dec. 22, 2015 (2 pages).

Brodsky et al., "Tamper-Respondent Assemblies with Bond Protection", U.S. Appl. No. 14/941,860, filed Nov. 16, 2015 (108 pages).

Fisher et al., "Enclosure with Inner Tamper-Respondent Sensor(s) and Physical Security Element(s)", U.S. Appl. No. 14/941,872, filed Nov. 16, 2015 (109 pages).

Brodsky et al, "Tamper-Respondent Assemblies", U.S. Appl. No. 14/941,887, filed Nov. 16, 2015 (109 pages).

Brodsky et al., "Circuit Boards and Electronic Packages with Embedded Tamper-Respondent Sensors", U.S. Appl. No. 14/941,908, filed Nov. 16, 2015 (41 pages).

Fisher et al., "Tamper-Respondent Assembly with Vent Structure", U.S. Appl. No. 14/955,283, filed Dec. 1, 2015 (61 pages).

Fisher et al., "Applying Pressure to Adhesive Using CTE Mismatch Between Components", U.S. Appl. No. 14/963,681, filed Dec. 9, 2015 (68 pages).

Brodsky et al., "Tamper-Respondent Assemblies with Enclosure-to-Board Protection", U.S. Appl. No. 14/974,036, filed Dec. 18, 2015 (55 pages).

Pamula et al., "Cooling of Integrated Circuits Using Droplet-Based Microfluidics", Association for Computing Machinery (ACM), GLSVLSI'03, Apr. 28-29, 2003 (pp. 84-87).

(56) References Cited

OTHER PUBLICATIONS

Sample et al., "Design of an RFID-Based Battery-Free Programmable Sensing Platform", IEEE Transactions on Instrumentation and Measurement, vol. 57, No. 11, Nov. 2008 (pp. 2608-2615).
Cabral, Jr. et al., "Controlling Fragmentation of Chemically Strengthened Glass", U.S. Appl. No. 14/700,877, filed Apr. 30, 2015 (48 pages).
Isaacs et al., Office Action for U.S. Appl. No. 14/637,501, filed Mar. 4, 2015, dated May 4, 2016 (20 pages).
Fisher et al., Office Action for U.S. Appl. No. 14/963,681, filed Dec. 9, 2015, dated May 6, 2016 (10 pages).
Campbell et al., "Tamper-Proof Electronic Packages With Two-Phase Dielectric Fluid", U.S. Appl. No. 15/139,503, filed Apr. 27, 2016 (60 pages).
Busby et al., "Tamper-Proof Electronic Packages Formed With Stressed Glass", U.S. Appl. No. 15/154,077, filed May 13, 2016 (45 pages).
Busby et al., "Tamper-Proof Electronic Packages With Stressed Glass Component Substrate(s)", U.S. Appl. No. 15/154,088, filed May 13, 2016 (56 pages).
Isaacs et al., "List of IBM Patents or Patent Applications Treated as Related" for U.S. Appl. No. 14/918,691, filed Oct. 21, 2015, dated May 18, 2016 (2 pages).
Holm, Ragnar, "Electric Contacts: Theory and Application", Spinger-Verlag, New York, 4th Edition, 1981 (pp. 10-19).
Clark, Andrew J., "Physical Protection of Cryptographic Devices", Advanced in Cyprtology, Eurocrypt '87, Springer, Berlin Heidelberg (1987) (11 pages).
Halperin et al., "Latent Open Testing of Electronic Packaging", MCMC-194, IEEE (1994) (pp. 83-33).
Jhang et al., "Nonlinear Ultrasonic Techniques for Non-Destructive Assessment of Micro Damage in Material: A Review", International Journal of Prec. Eng. & Manuf., vol. 10, No. 1, Jan. 2009 (pp. 123-135).
Isaacs et al., "Tamper Proof, Tamper Evident Encryption Technology", Pan Pacific Symposium SMTA Proceedings (2013) (9 pages).
Zhou et al., "Nonlinear Analysis for Hardware Trojan Detection", ICSPCC2015, IEEE (2015) (4 pages).
Harting Mitronics, "Saftey Caps for Payment Terminals", http://harting-mitronics.ch/fileadmin/hartingmitronics/case_studies/Saftey_caps_for_payment_terminals.pdf, downloaded Aug. 2016 (2 pages).
Brodsky et al., "Circuit Layouts of Tamper-Respondent Sensors", U.S. Appl. No. 15/187,002, filed Jun. 20, 2016 (110 pages).
Brodsky et al., "Tamper-Respondent Assemblies with Enclosure-to-Board Protection", U.S. Appl. No. 15/193,525, filed Jun. 27, 2016 (54 pages).
Fisher et al., "Applying Pressure to Adhesive Using CTE Mismatch Between Components", U.S. Appl. No. 15/193,556, filed Jun. 27, 2016 (71 pages).
Busby et al., "Tamper-Respondent Assembly with Nonlinearity Monitoring", U.S. Appl. No. 15/194,738, filed Jun. 28, 2016 (48 pages).
Dangler et al., "Tamper-Respondent Sensors with Formed Flexible Layer(s)", U.S. Appl. No. 15/249,663, filed Aug. 29, 2016 (109 pages).
Brodsky et al., "Overlapping, Discrete Tamper-Respondent Sensors", U.S. Appl. No. 15/249,671, filed Aug. 29, 2016 (109 pages).
Dangler et al., "Tamper-Respondent Assemblies with Region(s) of Increased Susceptibility to Damage", U.S. Appl. No. 15/249,676, filed Aug. 29, 2016 (110 pages).
Brodsky et al., Notice of Allowance for U.S. Appl. No. 14/974,036, filed Dec. 18, 2015, dated Jun. 3, 2016 (18 pages).
Fisher et al., Office Action for U.S. Appl. No. 14/865,686, filed Sep. 25, 2015, dated Jun. 29, 2016 (17 pages).
Fisher et al., Notice of Allowance for U.S. Appl. No. 14/963,681, filed Dec. 9, 2015, dated Jul. 5, 2016 (7 pages).
Brodsky et al., Office Action for U.S. Appl. No. 14/865,651, filed Sep. 25, 2015, dated Jul. 13, 2016 (10 pages).
Dragone et al., "Tamper-Respondent Assembly with Sensor Connection Adapter", U.S. Appl. No. 15/268,959, filed Sep. 19, 2016 (45 pages).
Dragone et al., "Vented Tamper-Respondent Assemblies", U.S. Appl. No. 15/275,748, filed Sep. 26, 2016 (53 pages).
Dragone et al., "Tamper-Respondent Assemblies with In Situ Vent Structure(s)", U.S. Appl. No. 15/275,762, filed Sep. 26, 2016 (72 pages).
Busby et al., "Tamper-Respondent Assemblies with Trace Regions of Increased Susceptibility to Breaking", U.S. Appl. No. 15/341,108, filed Nov. 2, 2016 (56 pages).
Brodsky et al., "Enclosure with Inner Tamper-Respondent Sensor(s)", U.S. Appl. No. 15/409,851, filed Jan. 19, 2017 (115 pages).
Brodsky et al., "Tamper-Respondent Assemblies with Enclosure-to-Board Protection", U.S. Appl. No. 15/423,833, filed Feb. 3, 2017 (54 pages).

* cited by examiner

TAMPER-RESPONDENT ASSEMBLY WITH PROTECTIVE WRAP(S) OVER TAMPER-RESPONDENT SENSOR(S)

BACKGROUND

Many activities require secure electronic communications. To facilitate secure electronic communications, an encryption/decryption system may be implemented on an electronic assembly or printed circuit board assembly that is included in equipment connected to a communications network. Such an electronic assembly is an enticing target for malefactors since it may contain codes or keys to decrypt intercepted messages, or to encode fraudulent messages. To prevent this, an electronic assembly may be mounted in an enclosure, which is then wrapped in a security sensor and encapsulated with polyurethane resin. A security sensor may be, in one or more embodiments, a web or sheet of insulating material with circuit elements, such as closely-spaced, conductive lines fabricated on it. The circuit elements are disrupted if the sensor is torn, and the tear can be sensed in order to generate an alarm signal. The alarm signal may be conveyed to a monitor circuit in order to reveal an attack on the integrity of the assembly. The alarm signal may also trigger an erasure of encryption/decryption keys stored within the electronic assembly.

SUMMARY

Provided herein, in one or more aspects, is an enhanced tamper-respondent assembly which includes an inner enclosure, at least one tamper-respondent sensor, at least one protective wrap, and an outer enclosure. The inner enclosure is sized to enclose at least one electronic component to be protected, and the at least one tamper-respondent sensor wraps around the inner enclosure. The at least one protective wrap overlies and wraps around the at least one tamper-respondent sensor and the inner enclosure. Together the inner enclosure, at least one tamper-respondent sensor and at least one protective wrap form, at least in part, a tamper-respondent subassembly. The outer enclosure receives, and surrounds, at least in part, the tamper-respondent subassembly, with the at least one tamper-respondent sensor and at least one protective wrap disposed between the inner enclosure and the outer enclosure.

In another aspect, a tamper-proof electronic package is provided which includes at least one electronic component to be protected, and a tamper-respondent assembly. The tamper-respondent assembly includes an inner enclosure, at least one tamper-respondent sensor, at least one protective wrap, and an outer enclosure. The inner enclosure surrounds and encloses, at least in part, the at least one electronic component, and the at least one tamper-respondent sensor wraps around and covers the inner enclosure. The at least one protective wrap overlies and wraps around the at least one tamper-respondent sensor and inner enclosure. Together the inner enclosure, at least one tamper-respondent sensor and at least one protective wrap form, at least in part, a tamper respondent subassembly. The outer enclosure receives, and surrounds, at least in part, the tamper-respondent subassembly, with the at least one tamper-respondent sensor and at least one protective wrap disposed between the inner enclosure and the outer enclosure.

In a further aspect, a method of fabricating a tamper-respondent assembly is provided, which includes: providing an inner enclosure sized to receive at least one electronic component to be protected; wrapping at least one tamper-respondent sensor around the inner enclosure; providing at least one protective wrap over the at least one tamper-respondent sensor and wrapping around the at least one tamper-respondent sensor and inner enclosure, wherein the inner enclosure, at least one tamper-respondent sensor and at least one protective wrap form, at least in part, a tamper-respondent subassembly; and providing an outer enclosure sized to receive, at least in part, the tamper-respondent subassembly, with the at least one tamper-respondent sensor and the at least one protective wrap disposed between the inner enclosure and the outer enclosure.

Additional features and advantages are realized through the techniques of the present invention. Other embodiments and aspects of the invention are described in detail herein and are considered a part of the claimed invention.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Aspects of the present invention and certain features, advantages, and details thereof, are explained more fully below with reference to the non-limiting example(s) illustrated in the accompanying drawings. Descriptions of well-known materials, fabrication tools, processing techniques, etc., are omitted so as not to unnecessarily obscure the invention in detail. It should be understood, however, that the detailed description and the specific example(s), while indicating aspects of the invention, are given by way of illustration only, and are not by way of limitation. Various substitutions, modifications, additions, and/or arrangements, within the spirit and/or scope of the underlying inventive concepts will be apparent to those skilled in the art for this disclosure. Note further that reference is made below to the drawings, which are not drawn to scale for ease of understanding, wherein the same reference numbers used throughout different figures designate the same or similar components. Also, note that numerous inventive aspects and features are disclosed herein, and unless otherwise inconsistent, each disclosed aspect or feature is combinable with any other disclosed aspect or feature as desired for a particular application, for establishing a secure volume about an electronic component or electronic assembly to be protected.

Figure 1:
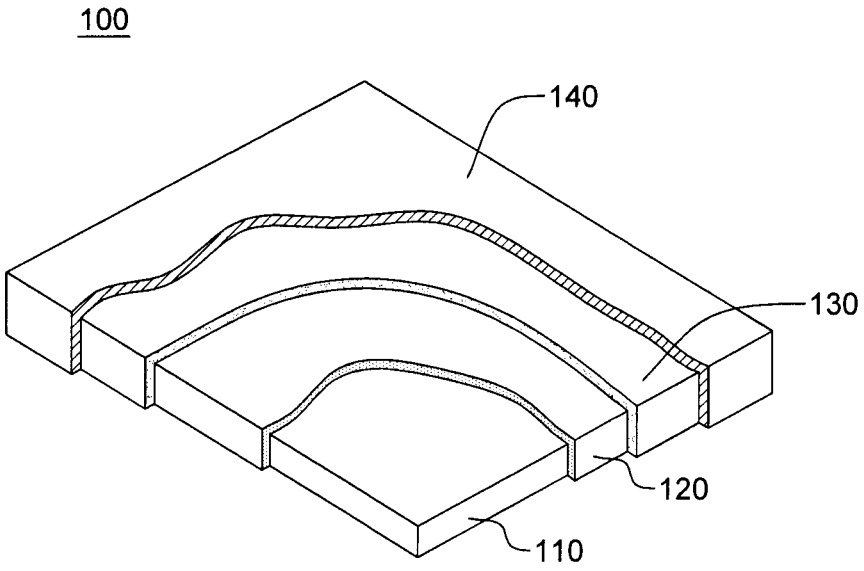
FIG. 1 is a partial cut-away of one embodiment of a tamper-proof electronic package to be modified, in accordance with one or more aspects of the present invention.

Reference is first made to FIG. 1 of the drawings, which illustrates one embodiment of an electronic assembly package 100 configured as a tamper-proof electronic package for purposes of discussion. In the depicted embodiment, an electronic assembly enclosure 110 is provided containing, for instance, an electronic assembly, which in one embodiment may include one or more electronic components, such as an encryption and/or decryption module and associated memory. The encryption and/or decryption module may comprise security-sensitive information with, for instance, access to the information stored in the module requiring use of a variable key, and with the nature of the key being stored in the associated memory within the enclosure.

In one or more implementations, a tamper-proof electronic package such as depicted is configured or arranged to detect attempts to tamper-with or penetrate into electronic assembly enclosure 110. Accordingly, electronic assembly enclosure 110 may also include, for instance, a monitor circuit which, if tampering is detected, activates an erase circuit to erase information stored within the associated memory, as well as the encryption and/or decryption module within the communications card. These components may be mounted on, and interconnected by, a multi-layer circuit board, such as a printed circuit board or other multi-layer substrate, and be internally or externally powered via a power supply provided within the electronic assembly enclosure.

In the embodiment illustrated, and as one example only, electronic assembly enclosure 110 may be surrounded by a tamper-respondent sensor 120, an encapsulant 130, and an outer, thermally conductive enclosure 140. In one or more implementations, tamper-respondent sensor 120 may include a tamper-respondent laminate that is folded around electronic assembly enclosure 110, and encapsulant 130 may be provided in the form of a molding. Tamper-respondent sensor 120 may include various detection layers, which are monitored through, for instance, a ribbon cable by the enclosure monitor, against sudden violent attempts to penetrate enclosure 110 and damage the enclosure monitor or erase circuit, before information can be erased from the encryption module. The tamper-respondent sensor may be, for example, any such article commercially available or described in various publications and issued patents, or any enhanced article such as disclosed herein.

By way of example, tamper-respondent sensor 120 may be formed as a tamper-respondent laminate comprising a number of separate layers with, for instance, an outermost lamination-respondent layer including a matrix of, for example, diagonally-extending or conductive or semi-conductive lines printed onto a thin insulating film. The matrix of lines forms a number of continuous conductors which would be broken if attempts are made to penetrate the film. The lines may be formed, for instance, by printing carbon-loaded Polymer Thick Film (PTF) ink onto the film and selectively connecting the lines on each side, by conductive vias, near the edges of the film. Connections between the lines and an enclosure monitor of the communications card may be provided via, for instance, one or more ribbon cables. The ribbon cable itself may be formed of lines of conductive ink printed onto an extension of the film, if desired. Connections between the matrix and the ribbon cable may be made via connectors formed on the film. As noted, the laminate may be wrapped around the electronic assembly enclosure 110 to define the tamper-respondent sensor 120 surrounding the enclosure.

In one or more implementations, the various elements of the laminate may be adhered together and wrapped around enclosure 110, in a similar manner to gift-wrapping a parcel, to define the tamper-respondent sensor shape 120. The assembly may be placed in a mold which is then filled with, for instance, cold-pour polyurethane, and the polyurethane may be cured and hardened to form an encapsulant 130. The encapsulant may, in one or more embodiments, completely surround the tamper-respondent sensor 120 and enclosure 110, and thus form a complete environmental seal, protecting the interior of the enclosure. The hardened polyurethane is resilient and increases robustness of the electronic package in normal use. Outer, thermally conductive enclosure 140 may optionally be provided over encapsulant 130 to, for instance, provide further structural rigidity to the electronic package.

Note that, as an enhancement, within a sealed electronic package, such as the tamper-proof electronic package depicted in FIG. 1 and described above, structures and methods for facilitating heat transfer from one or more electronic components disposed therein outwards through the enclosure and any other layers of the electronic package may be provided, as described further below.

Figure 2:
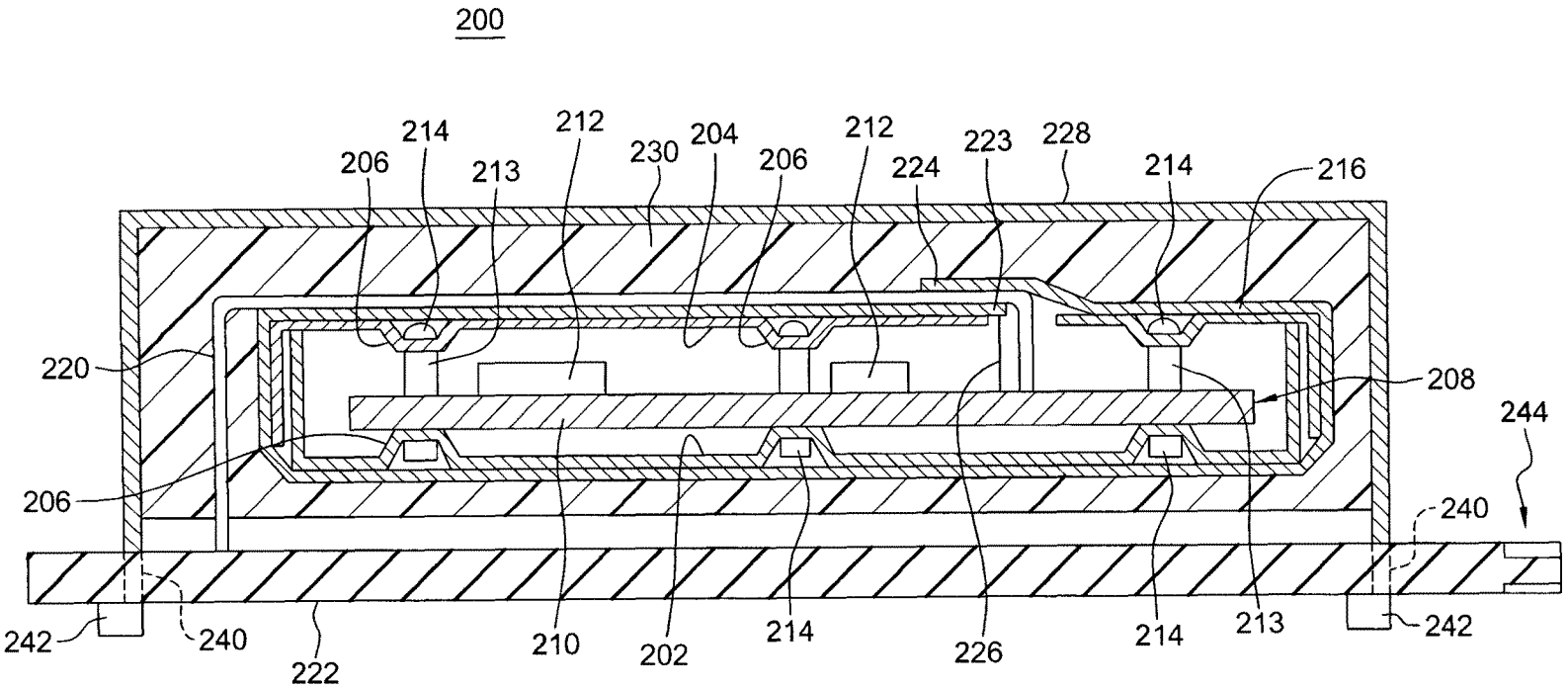
FIG. 2 (PRIOR ART)
FIG. 2 is a cross-sectional elevational view of one embodiment of a prior art, tamper-proof electronic package comprising an electronic circuit.

FIG. 2 depicts in detail one embodiment of a typical tamper-proof electronic package 200. Electronic package 200 is defined by, for instance, a base metal shell 202 and a top metal shell 204. Outer surfaces of base metal shell 202 and top metal shell 204 may be provided with standoffs 206, with an electronic assembly 208 resting on standoffs 206 defined in base metal shell 202. Electronic assembly 208 may include, for instance, a printed circuit board 210 with electronic components 212 that are electrically connected via conductors (not shown) defined within or on printed circuit board 210.

Hollow spacers 213 may be placed below dimples 206 in top metal shell 204, and rivets 214 provided, extending through openings in dimples 206, through hollow spacers 213 and through openings in printed circuit board 210 to base metal shell 202 in order to fixedly secure electronic assembly 208 within the enclosure formed by base and top metal shells 202, 204. A security mesh or tamper-respondent sensor 216 is wrapped around the top, base, and four sides of the enclosure formed by base and top metal shells 202, 204. As illustrated, in one or more embodiments, top metal shell 204 may have an opening through which a bus 220 extends. One end of bus 220 may be connected to conductors (not shown) on printed circuit board 210, and the other end may be connected to conductors (not shown) on a printed circuit board 222. As bus 220 passes through the opening, the bus extends between an inner edge region 223 of the security mesh 216 and an overlapping, outer edge region 224 of the security mesh 216. A group of wires 226 connect, in one embodiment, security mesh 216 to conductors on printed circuit board 210. Circuitry on printed circuit board 210 is responsive to a break or discontinuity in security sensor array 216, in which case, an alarm signal may be emitted on bus 220, and also encryption/decryption keys stored within electronic assembly 208 may be erased.

In one or more implementations, liquid polyurethane resin may be applied to security mesh 216 and cured. An outer, thermally conductive enclosure 228, such as a copper enclosure, may be filled with liquid polyurethane resin with the electronic assembly and inner enclosure and security mesh suspended within it. Upon curing the resin, the electronic assembly and inner enclosure and security mesh become embedded in a polyurethane block or encapsulant 230, as shown. The enclosure 228 is mounted on the printed circuit board 222, which can be accomplished using, for instance, legs 240 which extend through slots in printed circuit board 222 and terminate in flanges 242, which are then bent out of alignment with the slots. Bus 220 may be connected, by way of printed circuit board 222 to connectors 244 located along, for instance, one edge of printed circuit board 222.

When considering tamper-proof packaging, the electronic package needs to maintain defined tamper-proof requirements, such as those set forth in the National Institutes of Standards and Technology (NIST) Publication FIPS 140-2, which is a U.S. Government Computer Security Standard, used as a reference to accredit cryptographic modules. The NIST FIPS 140-2 defines four levels of security, named Level 1 to Level 4, with Security Level 1 providing the lowest level of security, and Security Level 4 providing the highest level of security. At Security Level 4, physical security mechanisms are provided to establish a complete envelope of protection around the cryptographic module, with the intent of detecting and responding to any unauthorized attempt at physical access. Penetration of the cryptographic module enclosure from any direction has a very high probability of being detected, resulting in the immediate zeroization of all plain text critical security parameters (CSPs). Security Level 4 cryptographic modules are useful for operation in physically unprotected environments. Security Level 4 also protects a cryptographic module against a security compromise due to environmental conditions or fluctuations outside of the module's normal operating ranges for voltages and temperature. Intentional excursions beyond the normal operating ranges may be used by an attacker to thwart the cryptographic module's defenses. The cryptographic module is required to either include specialized environmental protection features designed to detect fluctuations and zeroize critical security parameters, or to undergo rigorous environmental failure testing to provide reasonable assurance that the module will not be affected by fluctuations outside of the normal operating range in a manner that can compromise the security of the module.

To address the demands of ever-improving anti-intrusion technology, and the higher-performance encryption/decryption functions being provided, enhancements to the tamper-proof, tamper-evident packaging for the electronic assembly at issue are desired. Numerous enhancements are described herein below to, for instance, tamper-respondent assemblies and tamper-respondent sensors. Note that the numerous inventive aspects described herein may be used singly, or in any desired combination. Additionally, in one or more implementations, the enhancements to tamper-proof electronic packaging described herein may be provided to work within defined space limitations for existing packages. For instance, one or more of the concepts described may be configured to work with peripheral component interconnect express (PCIe) size limits, and the limitations resulting from being capsulated in, for instance, an insulating encapsulant.

Thus, disclosed herein below with reference to FIGS. 3A-5C are various approaches and/or enhancements to creating a secure volume for accommodating one or more electronic components, such as one or more encryption and/or decryption modules and associated components of a communications card or other electronic assembly.

Figure 3A:
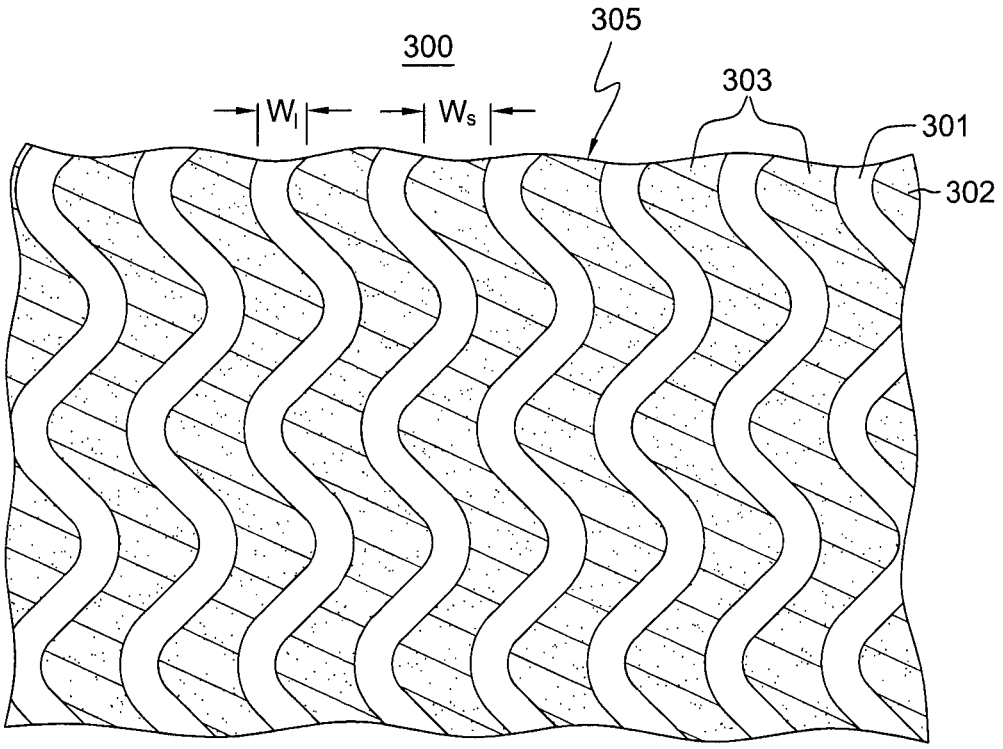
FIG. 3A depicts one embodiment of a tamper-respondent sensor comprising one or more flexible layers and circuit lines forming at least one tamper-detect network, in accordance with one or more aspects of the present invention.

FIG. 3A depicts a portion of one embodiment of a tamper-respondent layer 305 (or laser and pierce-respondent layer) of a tamper-respondent sensor 300 or security sensor, such as discussed herein. In FIG. 3A, the tamper-respondent layer 305 includes circuit lines or traces 301 provided on one or both opposite sides of a flexible layer 302, which in one or more embodiments, may be a flexible insulating layer or film. FIG. 3A illustrates circuit lines 301 on, for instance, one side of flexible layer 302, with the traces on the opposite side of the film being, for instance, the same pattern, but (in one or more embodiments) offset to lie directly below spaces 303, between circuit lines 301. As described below, the circuit lines on one side of the flexible layer may be of a line width $W_l$ and have a pitch or line-to-line spacing $W_s$ such that piercing of the layer 305 at any point results in damage to at least one of the circuit lines traces 301. In one or more implementations, the circuit lines may be electrically connected in-series or parallel to define one or more conductors which may be electrically connected in a network to an enclosure monitor, which monitors the resistance of the lines, as described herein. Detection of an increase, or other change, in resistance, caused by cutting or damaging one of the traces, will cause information within the encryption and/or decryption module to be erased. Providing conductive lines 301 in a pattern, such as a sinusoidal pattern, may advantageously make it more difficult to breach tamper-respondent layer 305 without detection. Note, in this regard, that conductive lines 301 could be provided in any desired pattern. For instance, in an alternate implementation, conductive lines 301 could be provided as parallel, straight conductive lines, if desired, and the pattern or orientation of the pattern may vary between sides of a layer, and/or between layers.

As noted, as intrusion technology continues to evolve, anti-intrusion technology needs to continue to improve to stay ahead. In one or more implementations, the above-summarized tamper-respondent sensor 300 of FIG. 3A may be disposed over an outer surface of an inner electronic enclosure, such as the inner electronic enclosure described above in connection with FIGS. 1 & 2. Numerous enhancements to the tamper-respondent sensor itself are described below.

In one or more aspects, disclosed herein is a tamper-respondent sensor 300 with circuit lines 301 having reduced line widths $W_l$ of, for instance, 200 μm, or less, such as less than or equal to 100 μm, or even more particularly, in the range of 30-70 μm. This is contrasted with conventional trace widths, which are typically on the order of 350 μm or larger. Commensurate with reducing the circuit line width $W_l$, line-to-line spacing width $W_s$ 303 is also reduced to less than or equal to 200 μm, such as less than or equal to 100 μm, or for instance, in a range of 30-70 μm. Advantageously, by reducing the line width $W_l$ and line-to-line spacing $W_s$ of circuit lines 301 within tamper-respondent sensor 300, the circuit line width and pitch is on the same order of magnitude as the smallest intrusion instruments currently available, and therefore, any intrusion attempt will necessarily remove a sufficient amount of a circuit line(s) to cause resistance to change, and thereby the tamper intrusion to be detected. Note that, by making the circuit line width of the smaller dimensions disclosed herein, any cutting or damage to the smaller-dimensioned circuit line will also be more likely to be detected, that is, due to a greater change in resistance. For instance, if an intrusion attempt cuts a 100 μm width line, it is more likely to reduce the line width sufficiently to detect the intrusion by a change in resistance. A change in a narrower line width is more likely to result in a detectable change in resistance, compared with, for instance, a 50% reduction in a more conventional line width of 350 μm to, for instance, 175 μm. The smaller the conductive circuit line width becomes, the more likely that a tampering of that line will be detected.

Note also that a variety of materials may advantageously be employed to form the circuit lines. For instance, the circuit lines may be formed of a conductive ink (such as a carbon-loaded conductive ink) printed onto one or both opposite sides of one or more of the flexible layers 302 in a stack of such layers. Alternatively, a metal or metal alloy could be used to form the circuit lines, such as copper, silver, intrinsically conductive polymers, carbon ink or nickel-phosphorus (NiP), or Omega-Ply®, offered by Omega Technologies, Inc. of Culver City, Calif. (USA), or Ticer™ offered by Ticer Technologies, Chandler, Ariz. (USA). Note that the process employed to form the fine circuit lines or traces on the order described herein is dependent, in part, on the choice of material used for the circuit lines. For instance, if copper circuit lines are being fabricated, then additive processing, such as plating up copper traces, or subtractive processing, such as etching away unwanted copper between trace lines, may be employed. By way of further example, if conductive ink is employed as the circuit line material, fine circuit lines on the order disclosed herein can be achieved by focusing on the rheological properties of the conductive ink formulation. Further, rather than simple pneumatics of pushing conductive ink through an aperture in a stencil with a squeegee, the screen emulsion may be characterized as very thin (for instance, 150 to 200 μm), and a squeegee angle may be used such that the ink is sheared to achieve conductive ink breakaway rather than pumping the conductive ink through the screen apertures. Note that the screen for fine line width printing such as described herein may have the following characteristics in one specific embodiment: a fine polyester thread for both warp and weave on the order of 75 micrometers; a thread count between 250-320 threads per inch; a mesh thickness of, for instance, 150 micrometers; an open area between threads that is at least 1.5× to 2.0× the conductive ink particle size; and to maintain dimensional stability of the print, the screen snap-off is kept to a minimum due the screen strain during squeegee passage.

In one or more implementations, circuit lines 301 of tamper-respondent sensor 300 are electrically connected to define one or more resistive networks. Further, the circuit lines may include one or more resistive circuit lines by selecting the line material, line width $W_l$ and line length $L_l$, to provide a desired resistance per line. As one example, a "resistive circuit line" as used herein may comprise a line with 1000 ohms resistance or greater, end-to-end. In one specific example, a circuit line width of 50 μm, with a circuit line thickness of 10 μm may be used, with the line length $L_l$ and material selected to achieve the desired resistance. At the dimensions described, good electrical conductors such as copper or silver may also be employed and still form a resistive network due to the fine dimensions noted. Alternatively, materials such as conductive ink or the above-noted Omega-Ply® or Ticer™ may be used to define resistive circuit lines.

In a further aspect, the flexible layer 302 itself may be further reduced in thickness from a typical polyester layer by selecting a crystalline polymer to form the flexible layer or substrate. By way of example, the crystalline polymer could comprise polyvinylidene difluoride (PVDF), or Kapton, or other crystalline polymer material. Advantageously, use of a crystalline polymer as the substrate film may reduce thickness of the flexible layer 302 to, for instance, 2 mils thick from a more conventional amorphous polyester layer of, for instance, 5-6 mils. A crystalline polymer can be made much thinner, while still maintaining structural integrity of the flexible substrate, which advantageously allows for far more folding, and greater reliability of the sensor after folding. Note that the radius of any fold or curvature of the sensor is necessarily constrained by the thickness of the layers comprising the sensor. Thus, by reducing the flexible layer thickness to, for instance, 2 mils, then in a four tamper-respondent layer stack, the stack thickness can be reduced from, for instance, 20 mils in the case of a typical polyester film, to 10 mils or less with the use of crystalline polymer films.

As noted, the circuit lines 301 forming the at least one resistive network may be disposed on either the first side or the second side of the opposite sides of the flexible layer(s) 302 within the tamper-respondent sensor 300, or on both the first and second sides. One embodiment of this depicted in FIG. 3B, wherein circuit lines 301 are illustrated on both opposite sides of flexible layer 302. In this example, circuit lines 301 on the opposite sides of the tamper-respondent sensor 302 may each have line widths $W_l$ less than or equal to 200 μm, and those lines widths may be the same or different. Further, the line-to-line spacing width $W_s$ between adjacent lines of the circuit lines 301 may also be less than or equal to 200 μm, and may also be the same or different. In particular, the circuit lines may be different line widths on the two different sides of the tamper-respondent layer, and the line-to-line spacing widths may also be different. For instance, a first side of the tamper-respondent layer may have circuit line widths and line-to-line spacings of approximately 50 microns, while the second side of the tamper-respondent layer may have circuit lines and line-to-line spacing of 70 microns. Intrusion through the sensor is potentially made more difficult by providing such different widths. Circuit lines 301 on the opposite sides of the flexible layer 302 may also be in the same or different patterns, and in the same or different orientations. If in the same pattern, the circuit lines may be offset, as noted above, such that the circuit lines of one side align to spaces between circuit lines on the other side.

Figure 3C:
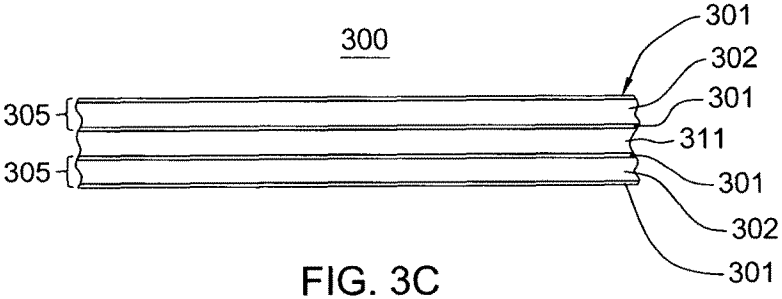
FIG. 3C is a cross-sectional elevational view of another embodiment of a tamper-respondent sensor, in accordance with one or more aspects of the present invention.

As illustrated in FIG. 3C, the tamper-respondent sensor 300 may comprise a stack of tamper-respondent layers 305 secured together via an adhesive 311, such as a double-sided adhesive film. The process may be repeated to achieve any desired number of tamper-respondent layers, or more particularly, any desired number of layers of circuit lines 301 within the tamper-respondent sensor to achieve a desired anti-intrusion sensor.

Figure 3E:
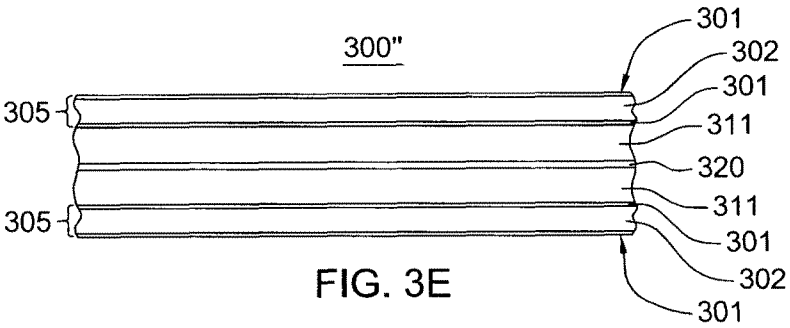
FIG. 3E depicts a cross-sectional elevational view of another embodiment of a tamper-respondent sensor, in accordance with one or more aspects of the present invention.
Figure 3B:
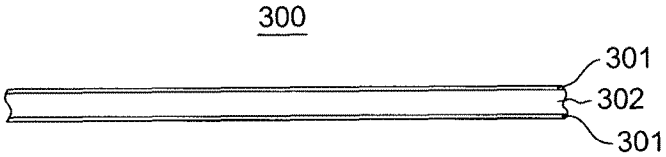
FIG. 3B is a cross-sectional elevational view of another embodiment of a tamper-respondent sensor, in accordance with one or more aspects of the present invention.
Figure 3D:
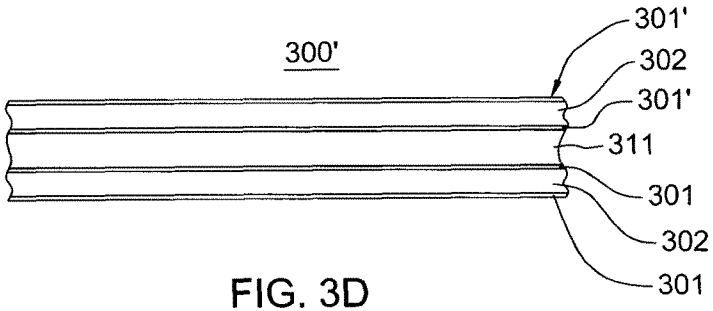
FIG. 3D is a cross-sectional elevational view of a further embodiment of a tamper-respondent sensor, in accordance with one or more aspects of the present invention.

An alternate tamper-respondent sensor 300' is depicted in FIG. 3D, where multiple flexible layers 302 with circuit lines are secured together via an adhesive 311, and by way of example, circuit lines are provided on one or both sides of each flexible layer. In this example, a first flexible layer 302 has first circuit lines 301 and a second flexible layer 302 has second circuit lines 301'. In one or more implementations the first circuit lines may have a first line width $W_l$ and the second circuit lines may have a second line width $W_l$, where the first line width of the first circuit lines 301 is different from the second line with the second circuit lines 301'. For instance, the first circuit line width may be 50 μm, and the second circuit line width may be 45 μm. Note that any desired combination of circuit line widths may be employed in this example, which assumes that the circuit line widths may be different between at least two of the layers. Additionally, the first circuit lines 301 of the first flexible layer may have first line-to-line spacing width $W_s$ and the second circuit lines 301' of second flexible layer may have a second line-to-line spacing width $W_s$, where the first line-to-line spacing width of the first circuit lines may be different from the second line-to-line spacing width of the second circuit lines. Note that this concept applies as well to circuit lines on only one side of flexible layer 302, where two or more of the flexible layers in the stack defining the tamper-respondent sensor may have different circuit line widths and/or different line-to-line spacing widths. This concept may be extended to any number of tamper-respondent layers within the tamper-respondent sensor to provide a desired degree of tamper protection.

In addition, or alternatively, the first circuit lines 301 of the first flexible layer may be formed of a first material, and the second circuit lines 301' of the second flexible layer may be formed of a second material, where the first material of the first circuit lines 301 may be different from the second material of the second circuit lines 301'. For instance, first circuit lines 301 may be formed of conductive ink, and second circuit lines 301' may be formed of a metal, such as copper. By providing tamper-respondent sensor 300' with at least some of the circuit lines formed of a metal material, such as copper, enhanced tamper-detection may be obtained. For instance, an intrusion tool passing through one or more layers of circuit lines 301' formed of a metal could generate debris which may be distributed during the intrusion attempt and result in shorting or otherwise damaging one or more other tamper-respondent layers within the tamper-respondent sensor 300'. If desired, more than two materials may be employed in more than one layers of circuit lines within the tamper-respondent sensor.

FIG. 3E depicts another embodiment of a tamper-respondent assembly 300", in accordance with one or more aspects of the present invention. In this implementation, multiple tamper-respondent layers 305 are secured with another flexible layer 320 in a stack using, for instance, one or more layers of an adhesive film 311. In one or more implementations, another flexible layer 320 could comprise a malleable metal film. In the example shown, the malleable metal film is disposed between two tamper-respondent layers 305, and thus, is disposed between two layers of circuit lines 301 on the different tamper-respondent layers 305. By way of example, malleable metal film 320 could comprise a sheet of copper or a copper alloy. By providing a thin malleable metal film 320 on the order of, for instance, 0.001" thickness, an attempt to penetrate through tamper-respondent sensor 300" would necessarily pass through malleable metal film 320, and in so doing generate debris which would be carried along by the intrusion tool or drill. This metal debris would facilitate detection of the intrusion attempt by potentially shorting or otherwise damaging one or more of the tamper-respondent layers 305 within tamper-respondent sensor 300". As a variation, the malleable metal film 320 could be applied directly to one side of a flexible layer 302 with the opposite side having circuit lines forming the at least one resistive network. Note that a similar concept applies where one or more of the layers of circuit lines 301 are formed of metal circuit lines, such as copper or silver, and other layers of circuit lines 301 are formed of, for instance, conductive ink. In such embodiments, clipping of one or more metal lines would generate metal debris that could carried along by the intrusion tool and ultimately interact with one or more other circuit lines of the tamper-respondent electronic circuit structure to enhance the likelihood of damage and thus detection of the intrusion attempt.

Based on the description provided herein, those skilled in the art will understand that the tamper-respondent sensors described above in connection with FIGS. 3A-3E may be employed with any of a variety of different tamper-respondent assemblies. For instance, one or more of the tamper-respondent sensors of FIGS. 3A-3E could be used in conjunction with an electronic enclosure to enclose, at least in part, one or more electronic components to be protected, with the tamper-respondent sensor overlying or being adhered to an outer surface of the electronic enclosure.

By way of further enhancement, in one or more implementations, thermal dissipation enhancements to the tamper-proof electronic package are disclosed herein, which work (for example) with defined size limitations for existing packages. For instance, a thermally enhanced electronic package may need to work with peripheral component interconnect express (PCIe) size limits, and the limitations resulting from being encapsulated in, for example, an insulating encapsulant.

Figure 4A:
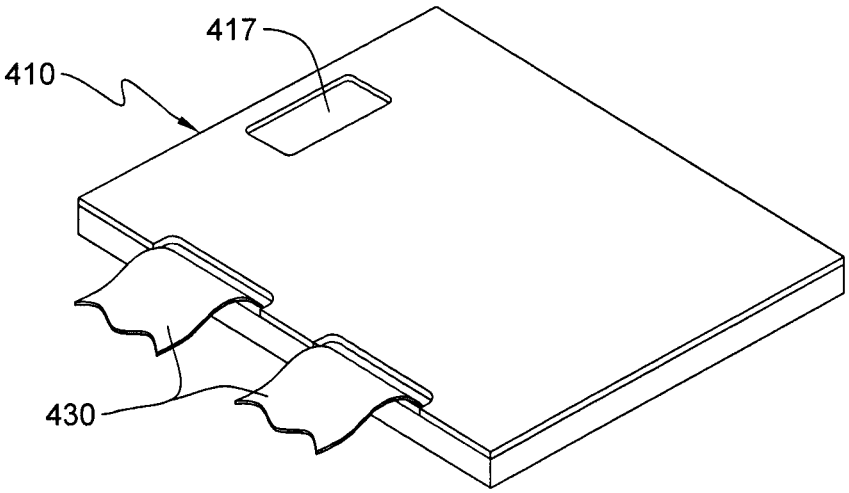
FIG. 4A depicts one embodiment of an electronic package to form part of a tamper-proof electronic package, in accordance with one or more aspects of the present invention.
Figure 4C:
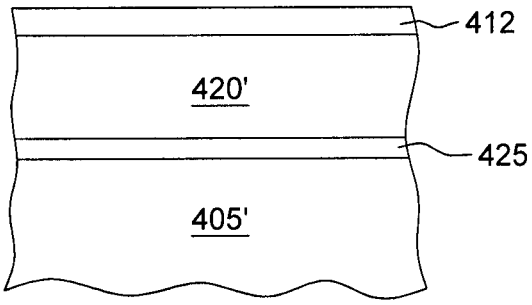
FIG. 4C is a partial cross-sectional, assembled elevational view of the thermally conductive cover and an electronic component of FIG. 4B, with a respective heat transfer element shown extending from the cover and coupled to the electronic component by a thermal interface material, in accordance with one or more aspect of the present invention.
Figure 4B:
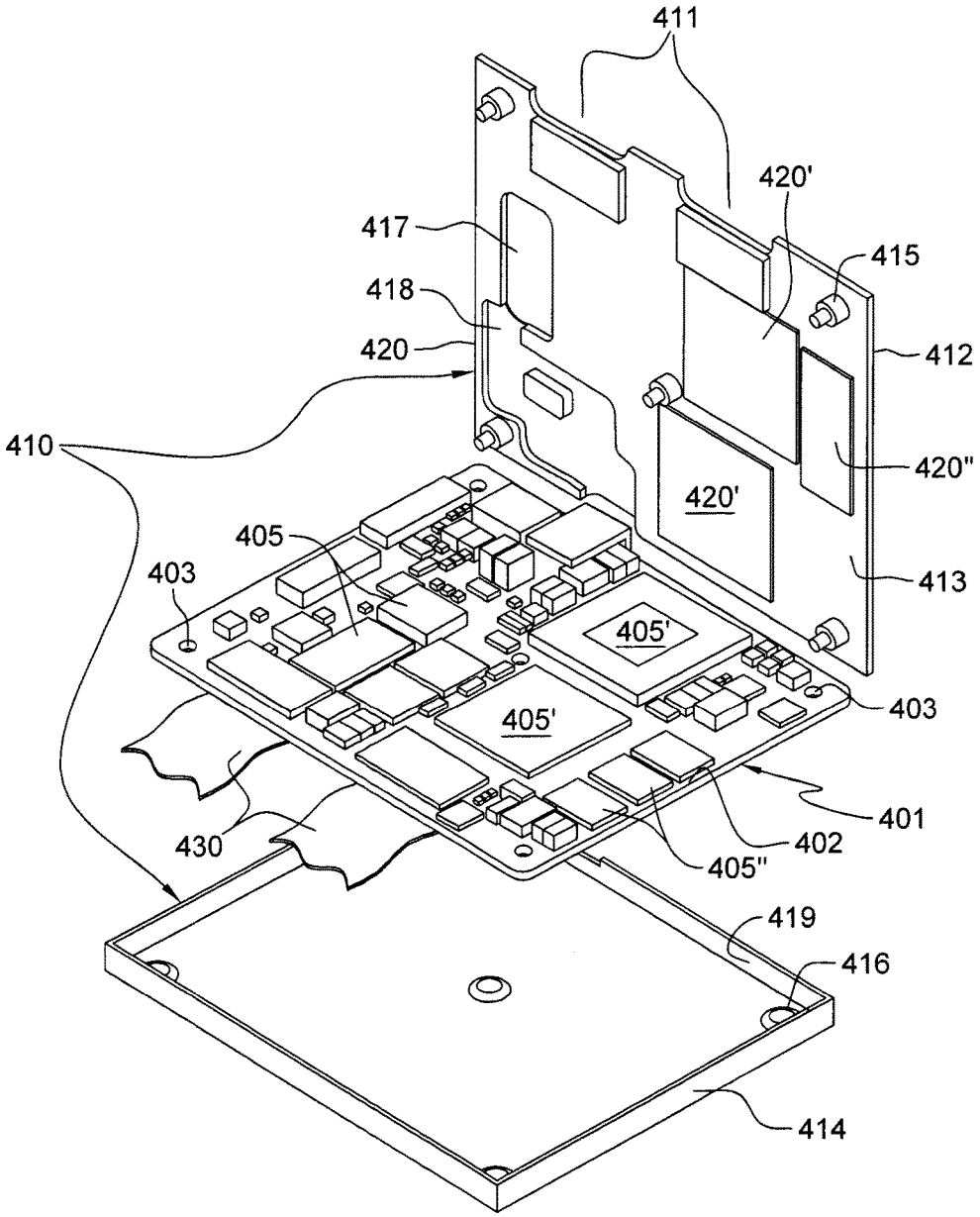
FIG. 4B depicts the electronic package of FIG. 4A, with a thermally conductive cover and base of the enclosure shown exploded from electronic components housed within the enclosure, in accordance with one or more aspects of the present invention.

Referring collectively to FIGS. 4A-4C, one detailed embodiment of an electronic package 400 with enhanced thermal dissipation is illustrated, by way of example. Electronic package 400 includes, in one or more embodiments, an enclosure 410 comprising an electronic system 401, such as an electronic assembly of a tamper-proof electronic package.

In the embodiment illustrated, electronic system 401 includes a substrate 402, such as a printed circuit board, and a plurality of heat-dissipating components, such as a plurality of electronic components 405, 405', 405", with one or more electronic components 405', 405" of the plurality of electronic components being higher heat-flux-producing components, such as, for instance, processor modules 405' and supporting memory modules 405".

In the depicted embodiment, enclosure 410 includes a thermally conductive cover 412 overlying electronic system 401, and a base 414, such as a thermally conductive base, disposed beneath electronic system 401. A plurality of spacers or standoffs 415 are provided extending, for instance, through respective openings 403 in substrate 402 and engaging respective recesses 416 in base 414. The plurality of spacers 415 define a spacing between thermally conductive cover 412 and base 414, and also set the height of the inner main surface 413 of thermally conductive cover 412 over, for instance, respective upper surfaces of the electronic components 405, 405', 405", of electronic system 401. This height is set sufficient to accommodate all the differently sized components within the electronic system without the cover physically contacting any of the components to guard against applying undue pressure to the components, potentially damaging the highest component or electrical interconnects to, for instance, substrate 402.

In the embodiment depicted, thermally conductive cover 412 includes recessed edge regions 411 along an edge thereof, and an opening 417. Note that recessed edge regions 411 and opening 417 are for one embodiment only of enclosure 410, being provided, for instance, for a tamper-proof electronic package, where enclosure 410 is to be surrounded by, in part, one or more layers such that an airtight or sealed compartment is defined within electronic package 400, and more particularly, within enclosure 410. By way of example, recessed edge regions 411 may be provided to accommodate flexible ribbon cables 430, which may, for instance, electrically interconnect a tamper-respondent sensor (not shown) surrounding enclosure 410 to monitor circuitry within electronic system 401. Opening 417 may be provided to facilitate, for instance, electrical interconnection to one or more components or connectors associated with electronic system 401, with the opening being subsequently sealed about the cabling to provide, in one embodiment, an airtight enclosure about electronic system 401. In addition, note that in one or more embodiments, thermally conductive cover 412 may include one or more recessed regions 418 in inner main surface 413 thereof, configured and sized to accommodate, for instance, one or more cables (not shown) electrically connecting to one or more components of electronic system 401.

In one or more implementations, thermally conductive cover 412 of enclosure 410 may be formed of copper, brass, or aluminum, or alternatively, gold, diamond, graphite, graphene, beryllium oxide, etc., assuming that the desired high thermal conductivity is provided by the material. In one or more other embodiments, a metal alloy may be employed, or multiple layers of thermally conductive material could be used to define thermally conductive cover 412. Base 414 may comprise, in one or more implementations, a thermally conductive material as well, such as the above-noted materials of thermally conductive cover 412. In addition, base 414 may include sidewalls 419 facilitating defining enclosure 410 about electronic system 401, and more particularly, about the substrate and the plurality of electronic components thereof.

As illustrated, one or more heat transfer elements 420 may be provided extending from main surface 413 of thermally conductive cover 412. For instance, heat transfer elements 420 may be coupled to, or integrated with, thermally conductive cover 412 to provide heat conduction pathways from one or more electronic components 405', 405", to thermally conductive cover 412 of enclosure 410, to facilitate heat dissipation from the one or more electronic components, which in one example, may be higher heat-flux-dissipating components within the enclosure. By way of example, relatively large heat transfer elements 420' may be provided, configured to and aligned over the higher heat-dissipating, electronic components 405', with each heat transfer element 420' being sized in one or more dimensions (for instance, in x-y dimensions) to correspond to the upper surface area and configuration of the respective electronic component 405', over which the heat transfer element is disposed, and to which the heat transfer element 420' couples via, for instance, a thermal interface material (TIM), such as a thermal interface pad or material offered by Parker Chomerics of Woburn, Mass., USA, a liquid dispense, thermally conductive material or gap pad, offered by the Bergquist Company, of Chanhassen, Minn., USA, or a phase change material, etc.

As depicted in FIG. 4C, in one or more assembled implementations, each heat transfer element 420, 420', 420" has a thickness or height appropriate for the space between the respective electronic component 405, 405', 405" (for which enhanced cooling is to be provided), and the inner surface 413 of thermally conductive cover 412. For instance, the thickness of each heat transfer element 420, 420', 420", is chosen so as to bring the respective heat transfer element in close proximity to the respective electronic component for which enhanced cooling is to be provided, without directly contacting the electronic component to prevent undue pressure from being applied to the electronic component, potentially damaging the component or its electrical interconnects. Within this space or gap separating the element and component, thermal interface material 425 is provided to couple the structures together and facilitate conductive transfer of heat from the respective electronic component to the thermally conductive cover of the enclosure through the heat transfer element, with the thermally conductive cover facilitating spreading and dissipating of the transferred heat outwards.

In one or more implementations, heat transfer elements 420, 420', 420" are provided sized to the particular electronic component or components, which they are configured to overlie. By way of example, heat transfer element 420" is configured to overlie multiple heat-dissipating components 405" to facilitate conductive transfer of heat from those components in parallel to thermally conductive cover 412. By way of further example, one or more heat transfer elements 420 may reside within recessed region 418 of thermally conductive over 412 and couple to one or more electronic components of the system lying beneath the recessed region 418 via the thermal interface material. As noted, the thickness of heat transfer elements, 420, 420', 420" may vary, depending upon the set spacing between the upper surfaces of the respective electronic components to which the heat transfer elements align, and main surface 413 of thermally conductive cover 412.

By way of additional enhancement, FIGS. 5A-5D depict different embodiments of tamper-proof electronic packages, in accordance with one or more aspects of the present invention. As described above in connection with FIGS. 1 & 2, in one or more implementations of a tamper-proof electronic package, liquid polyurethane resin is poured around and cured to encapsulate the tamper-respondent sensor and enclosure containing the component to be protected. Although forming a good seal, the use of poured resin to encapsulate a tamper-respondent sensor and inner electronic enclosure adds complexity to the fabrication process and, more significantly, results in a structure which provides less than optimal conduction of heat from, for instance, components within the tamper-proof electronic package.

In place of a poured resin, one or more protective wraps, such as one or more sheets of a solid, thermally conductive gap filler material may be employed with an adhesive securing, for instance, the protective wrap (s) about the tamper-respondent sensor(s) and inner enclosure. With this modification, significantly improved tamper-proof electronic packaging may be provided with improved thermal performance, allowing for increased electronic performance. Additionally, fabrication complexity is reduced as well.

Advantageously, the enhanced tamper-respondent assemblies disclosed herein meet the requirements set forth in NIST document FIPS 140-2, level 4 for tamper-proof, tamper-evident technology for encryption cards. Further, the disclosed tamper-proof electronic packages, such as depicted in FIGS. 5A-5D, work with current input/output cabling, and may be employed with a wide variety of tamper-respondent sensors, such as any of the tamper-respondent sensors described above in connection with FIGS. 1-3E. Advantageously, in one or more implementations, both an inner electronic enclosure, and an outer electronic enclosure are provided, and both are thermally conductive enclosures. The thermally conductive inner enclosure facilitates conduction of heat from one or more electronic components within the secure volume outward through the tamper-respondent assembly to the thermally conductive outer enclosure, which functions as a heat sink for the assembly. Further, the tamper-respondent assemblies depicted in FIGS. 5A-5D can be used with current vent approaches, such as described in U.S. Pat. No. 7,214,874 or 8,287,336, and with heat transfer elements or thermal pedestals such as described above in connection with FIGS. 4A-4C to facilitate conduction of heat from one or more electronic components to the tamper-respondent assembly surrounding the components and forming the secure volume. Advantageously, the tamper-respondent assemblies described below may be readily adapted to facilitate protecting current and future products, such as current and future encryption/decryption cards.

Figure 5A:
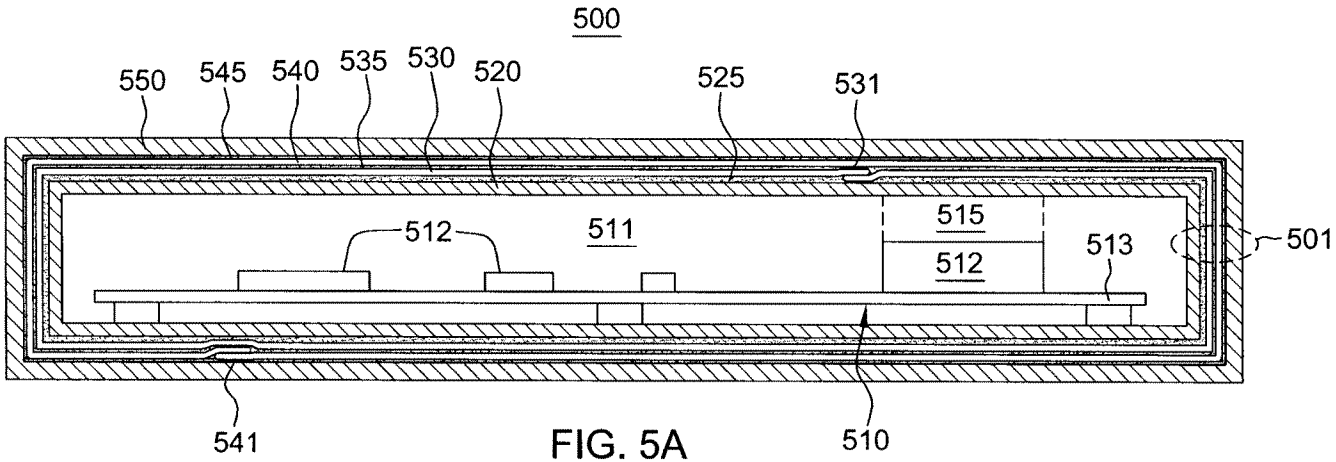
FIG. 5A is a cross-sectional elevational view of one embodiment of a tamper-proof electronic package, in accordance with one or more aspects of the present invention.

Referring to FIG. 5A, one embodiment of a tamper-proof electronic package 500 is depicted which includes one or more electronic components 510 and a tamper-proof assembly 501 defining a secure volume 511 about electronic component(s) 510. In the depicted example, electronic component(s) 510 comprises by way of example, an electronic assembly of multiple electronic components 512 electrically connected via conductors (not shown) defined within or on a circuit board 513.

In one or more embodiments, tamper-respondent assembly 501 may include an inner enclosure 520 sized to receive the electronic component(s) 510 to be protected. By way of example, one or more implementations, inner enclosure 520 may be a thermally conductive, inner enclosure, and may comprise multiple housing elements, such as a base metal shell and a top metal plate or shell, such as in the above-described embodiments. In one specific example, thermally conductive inner enclosure 520 may be fabricated of copper, or other good thermally conductive metal.

Wrapped around inner enclosure 520 is one or more tamper-respondent sensor 530. In one or more implementations, tamper-respondent sensor(s) 530 is wrapped around inner enclosure 520 in a similar manner to gift-wrapping a parcel, with one or more regions of the tamper-respondent sensor overlapping 531 about inner enclosure 520. An adhesive 525 may be provided between tamper-respondent sensor(s) 530 and inner enclosure 520 to facilitate holding tamper-respondent sensor(s) in fixed position about inner enclosure 520. In one or more alternate implementations, no adhesive 525 may be employed between tamper-respondent sensor(s) 530 and inner enclosure 520, or may be employed only in selected regions between the tamper-respondent sensor(s) and inner enclosure.

As noted, as a thermal performance enhancement, one or more protective wraps or layers 540 are employed within tamper-respondent assembly 501 in place of, for instance, the above-described cured resin surrounding the tamper-respondent sensor and inner enclosure. By way of example, the protective wrap(s) 540 may comprise a flexible, thermally conductive sheet, layer, or pad, such as a layer of thermally conductive gap filler material. By way of specific example, protective wrap(s) 540 could comprise a layer of ThermaCool®, TC100, TC2006, TC 3006 or TC3008 provided by Stockwell Elastomerics, Inc., of Philadelphia, Pa., U.S.A. Alternatively, the protective wrap (s) could comprise a thermally conductive sponge material, such as the R10404 material available from Stockwell Elastomerics. These exemplary materials provide good physical protection to the underlying tamper-respondent sensor(s) to prevent the tamper-respondent sensor, and in particular, the tamper-detect network of the sensor from being damaged by contact with, for instance, one or more surfaces of outer enclosure 550 of tamper-respondent assembly 501. By way of example, protective wrap(s) 540 may have an optimal thickness range of 0.1 to 3.0 mm.

As shown, protective wrap(s) 540 is wrapped around tamper-respondent sensor(s) 530 and inner enclosure 520. For instance, protective wrap 540 may be wrapped around tamper-respondent sensor(s) 530 in a similar manner to gift wrapping a parcel, and may include one or more regions of overlap 541. An adhesive 535 may be provided between tamper-respondent sensor(s) and protective wrap (s) 540 to secure the sensor and the wrap together. By way of example, adhesive 535 may be a thermally conductive adhesive, such as a thermally conductive thermoset material that is also chemically resistant to attack. For instance, 1-4173 thermally conductive adhesive offered by Dow Corning of Midland, Mich., U.S.A. may be used. Note in this regard that, in one or more other implementations, the tamper-respondent sensor(s) and overlaying protective wrap(s) could be pre-assembled together prior to wrapping about inner enclosure 520, that is, rather than being separately wrapped about the inner enclosure as illustrated. Together, the thermally conductive adhesive 535 and protective wrap 540 provide significantly greater thermal transferability than, for instance, the cured resin approach described above.

If desired, an additional adhesive layer 545 may be employed about protective wrap(s) 540 to adhere and provide good coupling of the protective wrap to one or more inner surfaces of outer enclosure 550. By way of example, outer enclosure 550 may comprise a thermally conductive, outer enclosure, and may be, for instance, an outer enclosure container and an outer enclosure cap, which together seal outer enclosure 550, for instance, about all six sides of the assembly in the exemplary embodiment of FIG. 5A. In one or more other implementations, adhesive layer 545 may be omitted from tamper respondent assembly 501.

As in the embodiment described above in connection with FIGS. 4A-4C, one or more heat transfer elements 515 (FIG. 5B), similar to the above-described heat transfer elements 420, 420', 420" of FIGS. 4A-4C, may be provided to facilitate conduction of heat from one or more electronic components 512 to tamper-respondent assembly 501, and hence outward to the outer enclosure 550 of the assembly, which is noted, in one or more embodiments, may comprise or function as a heat sink. For instance, if desired, outer enclosure 550 could include one or more air cooled fins (not shown) projecting from an outer surface of outer enclosure 550.

Figure 5B:
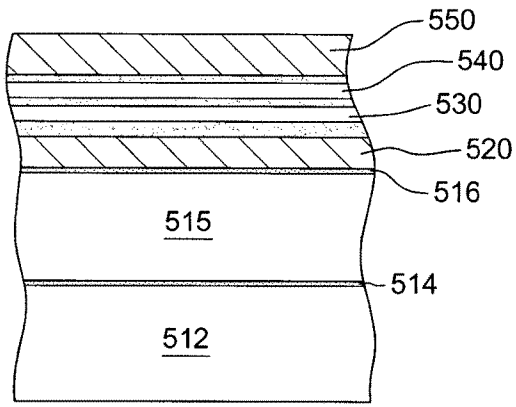
FIG. 5B is a partial cross-sectional elevational view of the tamper-proof electronic package of FIG. 5A, in accordance with one or more aspect of the present invention.

As depicted in FIG. 5B, in one or more assembled implementations, each heat transfer element 515 has a thickness or height appropriate for the space between the respective electronic component 512 (for which enhanced cooling is to be provided), and an inner surface of inner enclosure 520 of tamper-respondent assembly 501. For instance, the thickness of each heat transfer element 515, coupled to the inner enclosure via an adhesive 516, may be chosen to bring the heat transfer element in close proximity to the respective electronic component for which enhanced cooling is provided without directly contacting the electronic component to prevent undue pressure from being applied to the electronic component, potentially damaging component or its electrical inner-connects. Within this space or gap separating the element and component, a thermal interface material 514 may be provided to couple the structure together and facilitate conductive transfer of heat from electronic component 512 to the thermally conductive inner enclosure 520 of tamper-respondent assembly 501 through heat transfer element 515, with the protective wrap(s) 540 and thermally conductive adhesives 525, 535, 545 facilitating conduction of the heat through tamper-respondent assembly 501 to thermally conductive outer enclosure 520, and thus dissipating the transferred heat outwards.

Figure 5C:
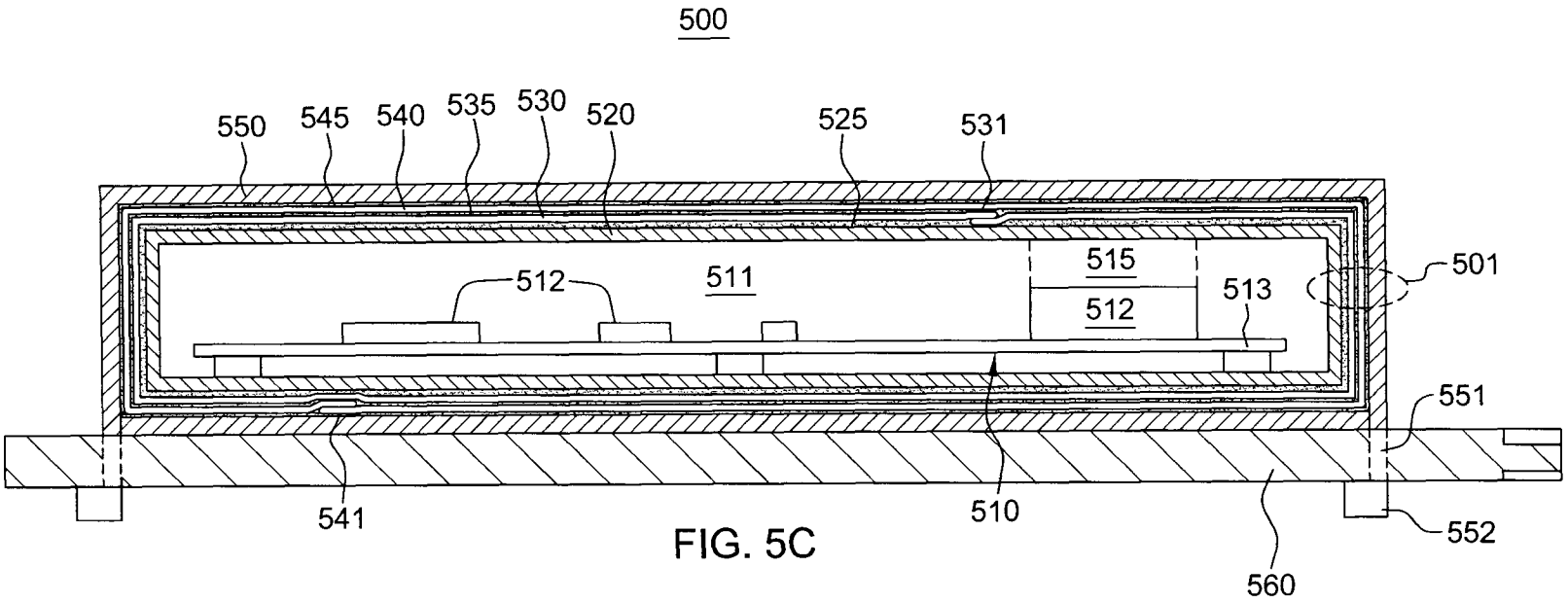
FIG. 5C is a cross-sectional elevational view of another embodiment of a tamper-proof electronic package, in accordance with one or more aspects of the present invention.
Figure 5D:
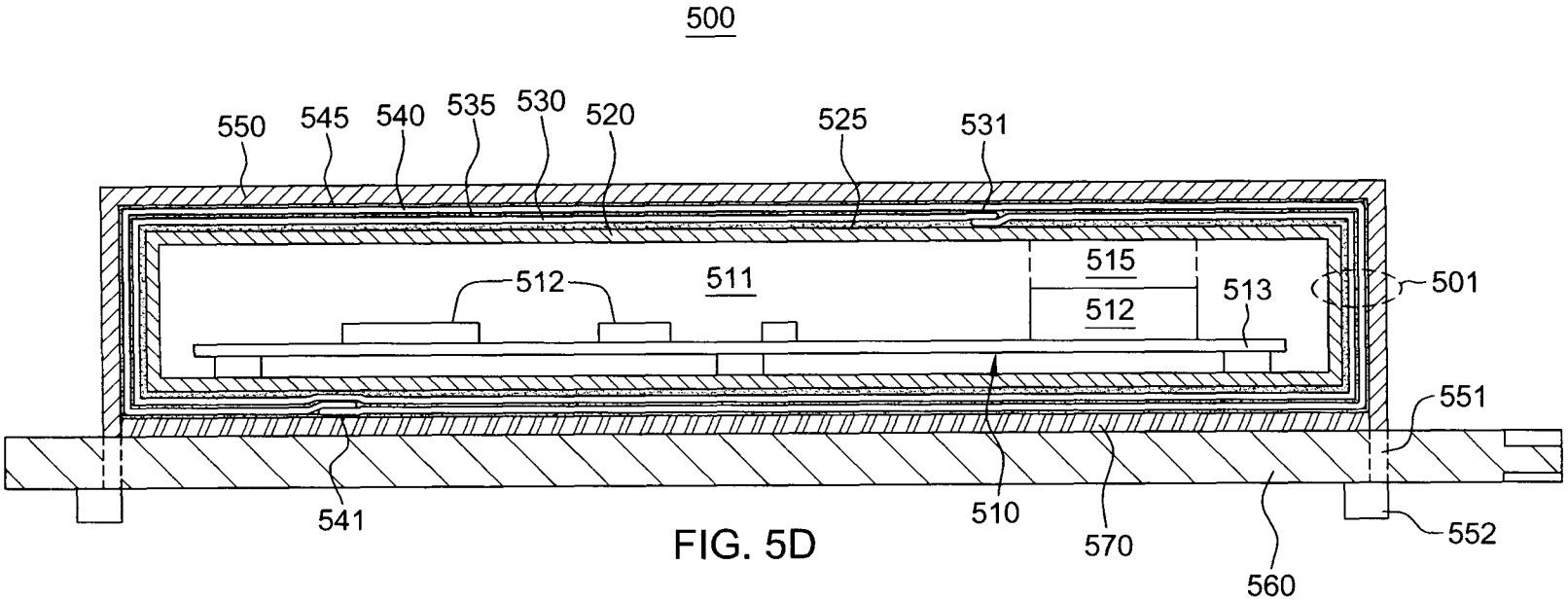
FIG. 5D is a cross-sectional elevational view of a further embodiment of a tamper-proof electronic package, in accordance with one or more aspects of the present invention.

FIGS. 5C & 5D depict alternate embodiments of a tamper-proof electronic package mounted to a circuit board 560, such as a mother board or daughter board. By way of example, FIG. 5C illustrates mounting of the tamper-proof electronic package 500 of FIG. 5A to circuit board 560. This can be accomplished in a variety of ways including using legs 551 in outer enclosure 550 which extent through respective slots in circuit board 560 and terminate, for instance, in flanges 552, or other connectors, such as screws, rivets, j-clips, epoxy, etc. Appropriate electrical connectors may also be provided to connect, for instance, the secure volume 511 of tamper-proof electronic package 500 to appropriate wiring or connectors on or associated with circuit board 560. In the example of FIG. 5C, outer enclosure 550 completely surrounds the tamper-proof subassembly comprising inner enclosure 520, tamper-respondent sensor(s) 530 and protective wrap(s) 540. As an alternate embodiment, as shown in FIG. 5D, an outer enclosure cap of outer enclosure 550 may be omitted and replaced with, for instance, any appropriate structural layer 570 disposed between, for example, the tamper-respondent subassembly and circuit board 560. Note that in one or more implementations, structural number 570 may also be thermally conductive, such as a thermally conductive plate, or may be any other structural member providing sufficient rigidity to maintain structural integrity of the tamper-respondent assembly 501 when operatively positioned as depicted.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. A tamper-respondent assembly comprising:

an inner enclosure sized to enclose at least one electronic component to be protected;

at least one tamper-respondent sensor wrapped around the inner enclosure, the at least one tamper-respondent sensor comprising;

at least one flexible layer having opposite first and second sides; and circuit lines forming at least one tamper-detect network, the circuit lines being disposed on at least one of the first side or the second side of the at least one flexible layer, and the circuit lines having a line width $W_l$<200 μm, and a line-to-line spacing width $W_s$<200 μm;

at least one protective wrap overlying and wrapped around the at least one tamper-respondent sensor and inner enclosure, wherein the inner enclosure, at least one tamper-respondent sensor and at least one protective wrap form, at least in part, a tamper-respondent subassembly;

an outer enclosure receiving, and surrounding, at least in part, the tamper-respondent subassembly, with the at least one tamper-respondent sensor and at least one protective wrap disposed between the inner enclosure and the outer enclosure; and wherein the at least one protective wrap comprises a flexible, thermally conductive material, the inner enclosure is a thermally conductive, inner enclosure, the outer enclosure is a thermally conductive, outer enclosure, and the at least one protective wrap facilitates conduction of heat from the thermally conductive, inner enclosure to the thermally conductive, outer enclosure.

2. The tamper-respondent assembly of claim 1, further comprising an adhesive layer disposed between and securing together the at least one protective wrap and the at least one tamper-respondent sensor.

3. The tamper-respondent assembly of claim 1, wherein the adhesive layer is a thermally conductive adhesive layer.

4. The tamper-respondent assembly of claim 1, wherein the at least one protective wrap comprises at least one layer of thermally conductive gap filler material.

5. The tamper-respondent assembly of claim 4, further comprising a thermally conductive adhesive layer disposed between and securing together the at least one protective wrap and the at least one tamper-respondent sensor.

6. The tamper-respondent assembly of claim 1, further comprising an outer enclosure cap, the outer enclosure and the outer enclosure cap together surrounding and enclosing the tamper-respondent subassembly.

7. The tamper-respondent assembly of claim 6, wherein the outer enclosure is mounted to a circuit board, and the outer enclosure cap is disposed between the tamper-respondent subassembly and the circuit board.

8. The tamper-respondent assembly of claim 7, wherein the outer enclosure cap comprises a thermally conductive plate disposed between the tamper-respondent subassembly and the circuit board.

9. A tamper-proof electronic package comprising:

at least one electronic component to be protected;

a tamper-respondent assembly comprising:

an inner enclosure surrounding and enclosing, at least in part, the at least one electronic component;

at least one tamper-respondent sensor wrapped around and covering the inner enclosure, the at least one tamper-respondent sensor comprising;

at least one flexible layer having opposite first and second sides; and circuit lines forming at least one tamper-detect network, the circuit lines being disposed on at least one of the first side or the second side of the at least one flexible layer, and the circuit lines having a line width $W_l \leq 200$ μm, and a line-to-line spacing width $W_s < 200$ μm;

at least one protective wrap overlying and wrapped around the at least one tamper-respondent sensor and inner enclosure, wherein the inner enclosure, at least one tamper-respondent sensor and at least one protective wrap form, at least in part, a tamper-respondent subassembly;

an outer enclosure receiving, and surrounding, at least in part, the tamper-respondent subassembly, with the at least one tamper-respondent sensor and at least one protective wrap disposed between the inner enclosure and the outer enclosure; and wherein the at least one protective wrap comprises a flexible, thermally conductive material, the inner enclosure is a thermally conductive, inner enclosure, the outer enclosure is a thermally conductive, outer enclosure, and the at least one protective wrap facilitates conduction of heat from the thermally conductive, inner enclosure to the thermally conductive, outer enclosure.

10. The tamper-respondent assembly of claim 9, further comprising an adhesive layer, disposed between and securing together the at least one protective wrap and the at least one tamper-respondent sensor, the adhesive layer being a thermally conductive adhesive layer.

11. The tamper-respondent assembly of claim 9, wherein the at least one protective wrap comprises at least one layer of thermally conductive gap filler material, and wherein the tamper-respondent assembly further comprises a thermally conductive adhesive layer disposed between and securing together the at least one protective wrap and the at least one tamper-respondent sensor.

12. The tamper-respondent assembly of claim 9, further comprising an outer enclosure cap, the outer enclosure and the outer enclosure cap together surrounding and enclosing the tamper-respondent assembly.

13. The tamper-respondent assembly of claim 12, wherein the outer enclosure is mounted to a circuit board, and the outer enclosure cap is disposed between the tamper-respondent subassembly and the circuit board.

14. A method of fabricating a tamper-respondent assembly, the method comprising:

providing an inner enclosure sized to receive at least one electronic component to be protected;

wrapping at least one tamper-respondent sensor around the inner enclosure, the at least one tamper-respondent sensor comprising;

at least one flexible layer having opposite first and second sides; and circuit lines forming at least one tamper-detect network, the circuit lines being disposed on at least one of the first side or the second side of the at least one flexible layer, and the circuit lines having a line width $W_l < 200$ μm, and a line-to-line spacing width $W_s < 200$ μm;

providing at least one protective wrap overlying the at least one tamper-respondent sensor and wrapping around the at least one tamper-respondent sensor and inner enclosure, wherein the inner enclosure, at least one tamper-respondent sensor and at least one protective wrap form, at least in part, a tamper-respondent subassembly;

providing an outer enclosure sized to receive and surround, at least in part, the tamper-respondent subassembly, with the at least one tamper-respondent sensor and the at least one protective sheet disposed between the inner enclosure and the outer enclosure; and wherein the at least one protective wrap comprises a flexible, thermally conductive material, the inner enclosure is a thermally conductive, inner enclosure, the outer enclosure is a thermally conductive, outer enclosure, and the at least one protective wrap facilitates conduction of heat from the thermally conductive, inner enclosure to the thermally conductive, outer enclosure.

15. The method of claim 14, further comprising securing together the at least one protective wrap and the at least one tamper-respondent sensor using an adhesive layer disposed between the at least one protective wrap and the at least one tamper-respondent sensor.

16. The method of claim 14, wherein the at least one protective wrap comprises at least one layer of thermally conductive gap filler material, and wherein the method further comprises providing a thermally conductive adhesive layer disposed between the at least one protective wrap and the at least one tamper-respondent sensor to secure together the at least one protective wrap and at least one tamper-respondent sensor.

17. The tamper-respondent assembly of claim 1, wherein the at least one tamper-respondent sensor comprises multiple flexible layers disposed in a stack, the at least one flexible layer being at least one flexible layer of the multiple flexible layers, and wherein the multiple flexible layers further comprise another flexible layer, the another flexible layer being a malleable metal film which generates metal debris with an attempted intrusion therethrough.

18. The tamper-respondent assembly of claim 17, wherein the malleable metal film comprises copper or a copper alloy.

19. The tamper-respondent assembly of claim 1, further comprising a heat transfer element coupled to, or integrated with, an inner main surface of the inner enclosure and residing within the inner enclosure between the inner main surface thereof and a respective electronic component of the at least one electronic component, the heat transfer element being thermally conductive and facilitating transfer of heat from the respective electronic component to the inner enclosure.

20. The tamper-respondent assembly of claim 19, wherein the heat transfer element is spaced from the respective electronic component, and a thermal interface filler material is disposed between and couples the heat transfer element and the respective electronic component, and facilitates conductive transfer of heat from the respective electronic component to the inner enclosure through the heat transfer element, the inner enclosure facilitating spreading transferred heat outwards through the at least one tamper-respondent sensor, at least one protective wrap and outer enclosure.

* * * * *